US009974118B2

(12) United States Patent
Anton Falcon et al.

(10) Patent No.: US 9,974,118 B2
(45) Date of Patent: May 15, 2018

(54) HEATING APPARATUS

(75) Inventors: Daniel Anton Falcon, Zaragoza (ES); José Miguel Burdio Pinilla, Zaragoza (ES); Claudio Carretero Chamarro, Zaragoza (ES); Jose Maria De la Cuerda Ortin, Zaragoza (ES); Pablo Jesus Hernandez Blasco, Cuarte de Huerva (ES); Oscar Jimenez Navascues, Cintruénigo (ES); Sergio Llorente Gil, Zaragoza (ES); Denis Navarro Tabernero, Zuera (ES); Jose Joaquin Paricio Azcona, Zaragoza (ES); Diego Puyal Puente, Zaragoza (ES); Magdy Saoudi Abdelfatah Saoudi, Hefna-Belbeis-Elsharkia (EG)

(73) Assignee: BSH Hausgeräte GmbH, Munich (DE)

( * ) Notice: Subject to any disclaimer, the term of this patent is extended or adjusted under 35 U.S.C. 154(b) by 1139 days.

(21) Appl. No.: 13/882,754

(22) PCT Filed: Oct. 31, 2011

(86) PCT No.: PCT/IB2011/054819
§ 371 (c)(1),
(2), (4) Date: May 1, 2013

(87) PCT Pub. No.: WO2012/063159
PCT Pub. Date: May 18, 2012

(65) Prior Publication Data

US 2013/0206750 A1 Aug. 15, 2013

(30) Foreign Application Priority Data

Nov. 10, 2010 (ES) ..... 201031651

(51) Int. Cl.
*H05B 6/12* (2006.01)
*H05B 1/02* (2006.01)
*H05B 6/06* (2006.01)

(52) U.S. Cl.
CPC ..... *H05B 1/0266* (2013.01); *H05B 6/062* (2013.01); *H05B 6/1209* (2013.01)

(58) Field of Classification Search
CPC .. H05B 1/0202; H05B 1/0261; H05B 1/0266; H05B 6/02; H05B 6/062; H05B 6/12; H05B 6/1209; H05B 2206/02
(Continued)

(56) References Cited

U.S. PATENT DOCUMENTS 4,599,504 A * 7/1986 Ito ..... H02H 7/1222 219/626
5,490,450 A * 2/1996 Lee ..... H05B 6/062 219/492

(Continued)

FOREIGN PATENT DOCUMENTS

| | | |
|---|---|---|
| EP | 1517091 A2 | 3/2005 |
| GB | 2162384 A | 1/1986 |
| WO | 2006072765 A1 | 7/2006 |

OTHER PUBLICATIONS

International Search Report PCT/IB2011/054819 dated Jan. 23, 2012.
National Search Report ES 201031651 dated Apr. 3, 2013.

*Primary Examiner* — Dana Ross
*Assistant Examiner* — Brandon Harvey
(74) *Attorney, Agent, or Firm* — Michael E. Tschupp; Andre Pallapies; Brandon G. Braun

(57) ABSTRACT

A heating apparatus, in particular a hob heating apparatus, with at least one heating connection for at least one heating element and at least one frequency unit. In order to provide a heating apparatus of the generic type with relatively high
(Continued)

operational reliability, it is proposed that the heating apparatus comprises a protective unit, which is provided for determining the existence of a conducting path between the frequency unit and the at least one heating connection.

34 Claims, 3 Drawing Sheets

(58) Field of Classification Search
USPC ..... 219/622, 625, 626
See application file for complete search history.

(56) References Cited

U.S. PATENT DOCUMENTS

| | | | | |
|---|---|---|---|---|
| 5,536,920 | A * | 7/1996 | Kwon | H05B 6/04 219/625 |
| 6,469,282 | B1 * | 10/2002 | Roberts | H05B 1/0266 219/451.1 |
| 2002/0053563 | A1 * | 5/2002 | Pastore | H05B 3/746 219/448.11 |
| 2004/0256378 | A1 * | 12/2004 | Shukla | F24C 7/082 219/490 |
| 2006/0221528 | A1 * | 10/2006 | Li | H02M 1/32 361/100 |
| 2007/0012684 | A1 * | 1/2007 | Liu | H05B 6/062 219/620 |
| 2009/0321424 | A1 | 12/2009 | Bunuel Magdalena et al. | |

* cited by examiner

HEATING APPARATUS

BACKGROUND OF THE INVENTION

The invention is based on a heating apparatus.

Heating apparatuses for cooktops are known, which comprise quite a large number of heating elements as well as frequency units. The heating elements are assigned to the frequency units by way of a switching arrangement of the heating apparatus.

BRIEF SUMMARY OF THE INVENTION

The object of the invention is in particular to provide a generic heating apparatus with greater operational reliability.

The invention is based on a heating apparatus, in particular a cooktop heating apparatus, having at least one heating connection for at least one heating element and having at least one frequency unit.

It is proposed that the heating apparatus has a protective unit, which is provided to determine the existence of a conducting path between the frequency unit and the heating connection. "Provided" here means in particular specially designed and/or equipped and/or programmed. A "heating element" refers in particular to an element which is provided to convert electrical energy to heat. In particular the heating element consists of a resistance heating unit or a radiant heating unit or preferably an induction heating unit, which is provided to convert electrical energy to heat indirectly by way of induced eddy currents. A "frequency unit" refers in particular to an electrical unit, which supplies the heating element with electrical energy. The frequency unit is preferably provided to generate an oscillating electrical signal, preferably with a frequency of at least 1 kHz, in particular at least 10 kHz and advantageously at least 20 kHz. The frequency unit preferably comprises at least one inverter, which particularly advantageously has two switching units. A "switching unit" refers in particular to a unit, which is provided to interrupt a conducting path containing the switching unit. The switching unit is preferably a bidirectional unipolar switch, which in particular allows a current flow through the switch along the conducting path in both directions and which in particular short circuits an electrical voltage in at least one poling direction. The inverter preferably comprises at least two bipolar transistors with isolated gate electrodes and in particular at least one damping capacitor. A "conducting path" refers in particular to a path between two points that is electrically conducting in particular for direct current. A specific electrical resistance everywhere on the conducting path at 20° C. is preferably maximum $10^{-4}$ Ωm, in particular maximum $10^{-5}$ Ωm, advantageously maximum $10^{-6}$ Ωm and particularly advantageously maximum $10^{-7}$ Ωm. The conducting path is preferably free of heating elements. The conducting path preferably comprises at least one further component that is not a conductor piece or a heating element, preferably a switching element of a switching arrangement and particularly advantageously a relay. A "heating connection" of a heating element refers in particular to an electrical connection point of the heating element. The electrical connection point is preferably a connecting point between a power supply line of the heating element, in particular a power supply cable of the heating element, and a further power supply line, in particular a conductor path of a printed circuit board. The heating connection is preferably provided on a face facing away from the frequency unit when viewed in the direction of the conducting path between the frequency unit and the heating connection, to connect the heating element electrically. A "protective unit" refers in particular to a unit, in particular an electronic unit, which has a protection function. The protection function preferably includes identifying a conducting path and forwarding this information to a control unit.

Such an embodiment allows operational reliability to be improved, in particular when the heating apparatus has a switching arrangement with switching elements, preferably in the form of electromechanical relays, and these are provided for periodic switching in the context of a time multiplex method. A "time multiplex method" refers in particular to a control method, with which individual time segments are defined, which are preferably run through periodically one after the other in a recurrent manner. In particular during a transition from a first to a second time segment a switching state of the switching arrangement changes, preferably so that in the first time segment at least a first heating element is supplied with energy and in the second time segment at least a second heating element is supplied with energy. In particular a power supplied to the heating elements during a time segment is greater than an average power supplied to the heating elements over time. A period duration of the control method is preferably 1 s to 5 s. The protective unit allows operating safety to be increased, as it is possible to identify the erroneous existence of a conducting path. In particular with a cooktop this prevents heating elements being operated load-free or with an empty cookpot. With induction cooktops in particular it is also possible to prevent magnetic fields spreading freely from the heating elements in the environment of the induction cooktop.

It is further proposed that the protective unit is provided to determine the existence of the conducting path based on a potential profile. A "potential profile" refers in particular to a time profile of an electrical potential, preferably at one point on the conducting path. An "electrical potential" at one point refers in particular to a path integral over an electric field from a reference point to the point. The reference point for the electrical potential is preferably a point on a ground line of the frequency unit. This reduces costs considerably, as there is no need for expensive current measuring devices for high-frequency alternating currents.

The protective unit is advantageously provided to analyze the potential profile at the heating connection. The statement that the protective unit is provided "to analyze the potential profile at the heating connection" means in particular that the protective unit is supplied with and internally processes an electrical voltage between the heating connection or a point with essentially the same electrical potential as the heating connection and the reference point as input voltage. "Essentially the same electrical potential" refers in particular to an electrical potential with a deviation of maximum 1% and preferably maximum 0.1%. An output voltage of the protective unit is preferably a digital output signal, which can in particular only have two values. This allows the existence of the conducting path to be determined reliably.

In one preferred embodiment it is proposed that the protective unit is provided to determine the existence of the conducting path based on a frequency spectrum of the potential profile. A "frequency spectrum" of the potential profile refers in particular to a mathematical function that is a function of a frequency, which describes the composition of the potential profile from signal components of different frequency. The statement that the protective unit is provided "to determine the existence of the conducting path based on a frequency spectrum of the potential profile" means in particular that the output signal and preferably the output voltage of the protective unit is a function of the frequency spectrum. In particular the protective unit identifies from the presence of high-frequency signals of a certain intensity in the frequency spectrum, in particular above a limit frequency, that a conducting path exists between the frequency unit and the heating connection. This allows the existence of the conducting path to be determined particularly reliably.

The protective unit advantageously comprises at least one high-pass filter, which is provided to discriminate between potential profiles. A "high-pass filter" refers in particular to an electronic filter unit, which is provided to allow the passage of signals with a frequency above a limit frequency at least essentially unattenuated and to damp signals with a lower frequency. "At least essentially unattenuated" means in particular that signal attenuation is maximum 15%, in particular maximum 10%, advantageously maximum 5% and particularly advantageously maximum 1%. The high-pass filter preferably comprises at least one capacitor. This allows discrimination between potential profiles in a simple and economical manner.

In a further embodiment of the invention it is proposed that the protective unit comprises a current sensor, which is provided to determine the existence of the conducting path. A "current sensor" refers in particular to a unit, which is provided to detect at least the presence of an electrical current. This saves costs compared with an embodiment with a current measuring device designed to measure a high-frequency alternating current.

It is further proposed that the heating apparatus comprises a control unit, which is provided to receive connection information from the protective unit and to initiate at least one safety measure in the event of the erroneous existence of a conducting path. A "control unit" refers in particular to an electronic unit, which is preferably at least partially integrated in a control and/or regulation unit of an induction cooktop and is preferably provided to control and/or regulate at least the frequency unit and a switching arrangement. The control unit preferably comprises a computation unit and in addition to the computation unit a storage unit. "Connection information" refers in particular to a connection status between the frequency unit and the heating connection. The connection information is preferably encoded in a digital signal, which can preferably only have two values. The "erroneous existence of the conducting path" refers in particular to an existence of the conducting path between the frequency unit and the heating connection, which is erroneous and deviates from a setting of the switching arrangement set by the control unit. In particular an erroneous existence of a conducting path can be due to a defective switching element, in particular a catching electromechanical relay and/or erroneous activation of the switching element. A "safety measure" refers in particular to a measure which is initiated in response to the erroneous existence of the conducting path and which is preferably intended to render the heating apparatus safe. The safety measure preferably comprises switching off all the frequency units. The safety measure preferably comprises outputting an error message and/or a maintenance request. Such an embodiment improves operating safety particularly advantageously.

A total number of all heating elements is advantageously greater than a total number of all frequency units. A "total number of all heating elements" refers in particular to the total number of all the heating elements in a cooktop. A "total number of all frequency units" refers in particular to the total number of all the frequency units in the cooktop. This reduces materials and costs. The total number of frequency units is advantageously two in the case of a cooktop having at least three heating elements. The total number of frequency units is advantageously four in the case of a matrix cooktop. A "matrix cooktop" refers in particular to a cooktop, in which the heating elements are arranged in a regular grid below a cooktop plate and a region of the cooktop plate that can be heated by means of the heating elements comprises preferably at least 60%, in particular at least 70%, advantageously at least 80% and particularly advantageously at least 90% of the overall surface of the cooktop plate. In particular the matrix cooktop comprises at least 10, in particular at least 20, advantageously at least 30 and particularly advantageously at least 40 heating elements. This ensures a high level of ease of operation despite a limited number of frequency units, in particular in the case of matrix cooktops, with which experience shows that generally a maximum of four cookpots are heated.

A method with an inventive heating apparatus, in particular a cooktop apparatus, having at least one heating connection for at least one heating element, at least one frequency unit and a protective unit, is also proposed, with which the protective unit determines the existence of a conducting path between the frequency unit and the heating connection. This improves operational reliability, in particular when the heating apparatus has switching elements, preferably in the form of electromechanical relays. Operating safety can also be improved, as the erroneous existence of a conducting path can be identified. This prevents heating elements being operated load-free, in particular in the case of a cooktop. It is also possible, in particular in the case of induction cooktops, to prevent magnetic fields spreading freely from the heating elements in the environment of the induction cooktop.

Further advantages will emerge from the descriptions of the drawings which follow. The drawings show two exemplary embodiments of the invention. The drawings, description and claims contain numerous features in combination. The person skilled in the art will expediently also consider the features individually and combine them in expedient further combinations.

DETAILED DESCRIPTION OF EXEMPLARY EMBODIMENTS OF THE PRESENT INVENTION

Figure 1A:
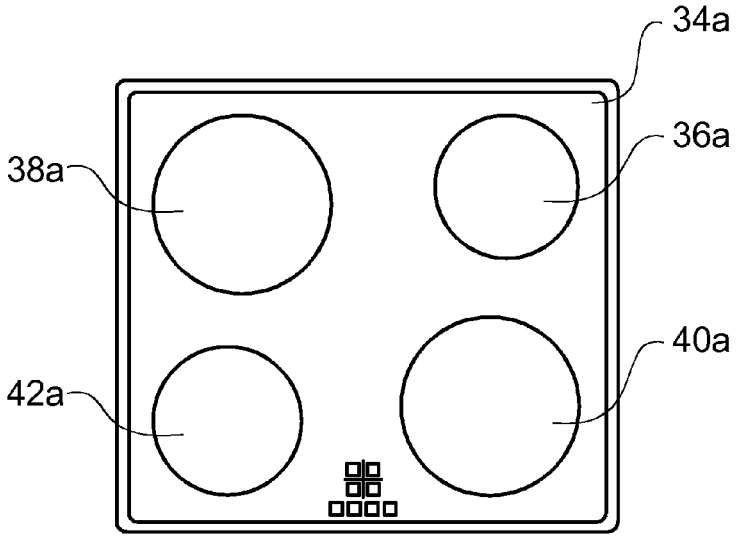
FIG. 1*a* shows an induction cooktop with four heating zones viewed from above.

FIG. 1*a* shows a top view of an induction cooktop with a cooktop plate 34*a* made of glass ceramic, on which four heating zones 36*a*, 38*a*, 40*a*, 42*a* are marked in the known manner. A heating apparatus (FIG. 1*b*) of the induction cooktop has four heating elements 18*a*, 20*a*, 22*a*, 24*a* configured as inductor coils, which can all be operated at the same time at different power stages. Each of the heating elements 18*a*, 20*a*, 22*a*, 24*a* is assigned to one of the cooking zones 36*a*, 38*a*, 40*a*, 42*a*, so that when the induction cooktop is used, each heating element 18*a*, 20*a*, 22*a*, 24*a* heats just one cookware element, for example a pot or pan. The heating apparatus has two frequency units 26*a*, 28*a*, by means of which the heating elements 18*a*, 20*a*, 22*a*, 24*a* can be supplied with energy by way of heating connections 10*a*, 12*a*, 14*a*, 16*a* of the heating apparatus. A total number of all heating elements 18*a*, 20*a*, 22*a*, 24*a* is therefore greater than a total number of all frequency units 26*a*, 28*a*. The two frequency units 26*a*, 28*a* each comprise an inverter 44*a*, 46*a* and a damping capacitor unit 48*a*, 50*a*. The inverter 44*a* has a first bipolar transistor with isolated gate electrode (the abbreviation IGBT is used in the following for this) 52*a* and a second IGBT 54*a*. The inverter 46*a* also has a first IGBT 56*a* and a second IGBT 58*a*. Alternatively instead of the IGBTs any other switching unit that appears expedient to the person skilled in the art can be used, preferably however a bidirectional unipolar switch.

The heating apparatus also has a country-specific alternating current voltage source 60*a*, which supplies a power network voltage with an effective value of 230 V and a frequency of 50 Hz. The described heating apparatus is intended in particular for operation in Germany. For heating apparatuses which are intended for operation in the US a corresponding alternating current voltage source supplies a power network voltage with 60 Hz. The voltage of the alternating current voltage source 60*a* passes first through a filter 62*a* of the heating apparatus, which eliminates high-frequency noise and is essentially a low-pass filter. A voltage filtered by the filter 62*a* is rectified by a rectifier 64*a* of the heating apparatus, which can be configured as a bridge rectifier, so that a rectified voltage $U_0$ is output at an output of the rectifier 64*a* and is present between a collector of the IGBT 52*a* and an emitter of the IGBT 54*a*. The rectified voltage $U_0$ is also present between a collector of the IGBT 56*a* and an emitter of the IGBT 58*a*. The damping capacitor units 48*a*, 50*a* each consist of two capacitors, with a first capacitor connected parallel to the first IGBT 52*a*, 56*a* and a second capacitor connected parallel to the second IGBT 54*a*, 58*a* of the respective frequency unit 26*a*, 28*a*.

The heating apparatus also has a switching arrangement 66*a*. The switching arrangement 66*a* comprises six switching elements 68*a*, 70*a*, 72*a*, 74*a*, 76*a*, 78*a*. The switching elements 68*a*, 70*a*, 72*a*, 74*a*, 76*a*, 78*a* are SPDT relays and of identical structure. Each of the switching elements 68*a*, 70*a*, 72*a*, 74*a*, 76*a*, 78*a* has a first, second and third contact and a coil, it being possible for the first contact to be connected in a conducting manner optionally to the second or third contact by corresponding activation of the coil. The first contact of the switching element 68*a* is connected in a conducting manner to the emitter of the IGBT 52*a*. The second contact of the switching element 68*a* is also connected to the first contact of the switching element 70*a*. The third contact of the switching element 68*a* is connected in a conducting manner to the first contact of the switching element 72*a*. The second contact of the switching element 70*a* is connected in a conducting manner to the heating connection 10*a*. The third contact of the switching element 70*a* is connected in a conducting manner to the heating connection 12*a*. The second contact of the switching element 72*a* is connected in a conducting manner to the heating connection 14*a*. The third contact of the switching element 72*a* is connected in a conducting manner to the heating connection 16*a*. The first contact of the switching element 74*a* is also connected in a conducting manner to the emitter of the IGBT 56*a*. The second contact of the switching element 74*a* is also connected to the first contact of the switching element 76*a*. The third contact of the switching element 74*a* is connected in a conducting manner to the first contact of the switching element 78*a*. The second contact of the switching element 76*a* is connected in a conducting manner to the heating connection 10*a*. The third contact of the switching element 76*a* is connected in a conducting manner to the heating connection 12*a*. The second contact of the switching element 78*a* is connected in a conducting manner to the heating connection 14*a*. The third contact of the switching element 78*a* is connected in a conducting manner to the heating connection 16*a*.

The heating element 18*a* is connected with a first contact to the heating connection 10*a*. The heating element 20*a* is connected with a first contact to the heating connection 12*a*. The heating element 22*a* is connected with a first contact to the heating connection 14*a*. The heating element 24*a* is connected with a first contact to the heating connection 16*a*. A second contact of the heating element 18*a* is connected in a conducting manner to a second contact of the heating element 20*a*. A second contact of the heating element 22*a* is also connected in a conducting manner to a second contact of the heating element 24*a*. The heating apparatus also has resonant capacitors 80*a*, 82*a*, 84*a*, 86*a*. The second contact of the heating element 18*a* is connected in a conducting manner to a first contact of the resonant capacitor 80*a* and to a first contact of the resonant capacitor 82*a*. The second contact of the heating element 22*a* is connected in a conducting manner to a first contact of the resonant capacitor 84*a* and to a first contact of the resonant capacitor 86*a*. Second contacts of the two resonant capacitors 80*a*, 84*a* are connected in a conducting manner to the collector of the IGBT 52*a*. Second contacts of the two resonant capacitors 82*a*, 86*a* are also connected in a conducting manner to the emitter of the IGBT 58*a*.

The heating apparatus comprises a control unit 32*a*, which is provided to control the switching arrangement 66*a* and the frequency units 26*a*, 28*a* by means of activation signals for the inverters 44*a*, 46*a* and to set a predefined heating power. The control unit 32*a* is designed to perform a time multiplex method, with which different operating modes can be used in the individual defined time segments of the time multiplex method. The operating modes used comprise a "dedicated mode", a "booster mode" and a "phase activation mode". The control mechanisms can be executed one after the other in different time segments of the time multiplex method.

In "dedicated mode" a frequency unit 26*a*, 28*a* supplies just one of the heating elements 18*a*, 20*a*, 22*a*, 24*a* with energy. The commonly used resonant capacitors 80*a*, 82*a* of the heating elements 18*a*, 20*a* and the commonly used resonant capacitors 84*a*, 86*a* of the heating elements 22*a*, 24*a* mean that there are restrictions when assigning the heating elements 18*a*, 20*a*, 22*a*, 24*a* to the frequency units 26*a*, 28*a*. Simultaneous operation of a number of heating elements 18*a*, 20*a*, 22*a*, 24*a* in dedicated mode is therefore only possible for the heating elements 18*a*, 20*a*, 22*a*, 24*a* which are connected to different resonant capacitors 80*a*, 82*a*, 84*a*, 86*a*. The activation signals for the inverters 44*a*, 46*a* of the frequency units 26*a*, 28*a* are independent of one another in this operating mode.

In booster mode one heating element 18*a*, 20*a*, 22*a*, 24*a* is operated in each instance by both frequency units 26*a*, 28*a* in a parallel manner, to achieve a higher heating power. The activation signals for the inverters 44*a*, 46*a* of the frequency units 26*a*, 28*a* are identical for both inverters 44*a*, 46*a* in this operating mode.

In phase activation mode two heating elements 18*a*, 20*a*, 22*a*, 24*a* with common resonant capacitors 80*a*, 82*a*, 84*a*, 86*a* are supplied respectively with energy by one frequency unit 26*a*, 28*a*. The activation signals for the inverters 44*a*, 46*a* of the frequency units 26*a*, 28*a* have the same frequency in this operating mode, thereby setting the total power of the two heating elements 18*a*, 20*a*, 22*a*, 24*a*. The relationship between the individual heating outputs of the two heating elements 18*a*, 20*a*, 22*a*, 24*a* is defined by a phase displacement between the activation signals. The activation signals are also adjusted to ensure zero voltage switching of the IGBTs 52*a*, 54*a*, 56*a*, 58*a* of the inverters 44*a*, 46*a* of the frequency units 26*a*, 28*a*. This minimizes switching losses.

The frequent switching operations of the switching elements 68*a*, 70*a*, 72*a*, 74*a*, 76*a*, 78*a* of the switching arrangement 66*a* with the time multiplex method mean that it is important to determine any malfunctions of the switching arrangement 66*a* or the activation of the switching arrangement 66*a*. Several hundred thousand switching operations per switching element 68*a*, 70*a*, 72*a*, 74*a*, 76*a*, 78*a* can be expected during the life of the induction cooktop. To minimize malfunctions, the frequency units 26*a*, 28*a* are switched off during the switching operations, so that the switching elements 68*a*, 70*a*, 72*a*, 74*a*, 76*a*, 78*a* are without power during the switching operation. But malfunction still cannot be totally excluded. Possible malfunctions include on the one hand malfunctions of the switching elements 68*a*, 70*a*, 72*a*, 74*a*, 76*a*, 78*a*, for example a catching relay or a defective component in a control power circuit of the relay, or on the other hand malfunctions of the control software of the switching elements 68*a*, 70*a*, 72*a*, 74*a*, 76*a*, 78*a*.

With the inventive heating apparatus a method is used, in which the existence of a conducting path between a frequency unit 26*a*, 28*a* and a heating connection 10*a*, 12*a*, 14*a*, 16*a* is determined by a protective unit 30*a* of the heating apparatus. The protective unit 30*a* determines the existence of the conducting path between one of the two frequency units 26*a*, 28*a* and one of the four heating connections 10*a*, 12*a*, 14*a*, 16*a* in at least one operating state based on a potential profile, which it analyzes at the heating connections 10*a*, 12*a*, 14*a*, 16*a*.

Figure 2:
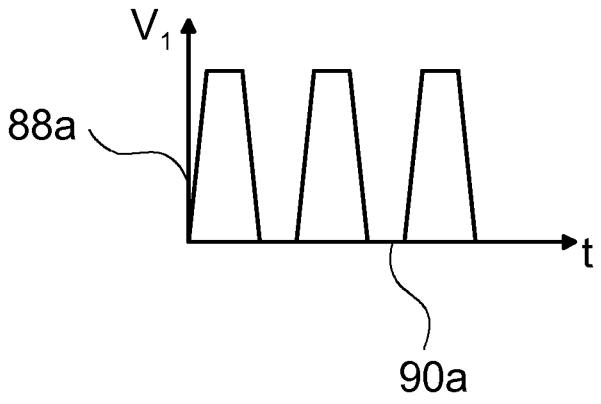
FIG. 2 shows a potential profile for an existing connection.

FIG. 2 shows a Cartesian coordinate system for a typical potential profile $V_1(t)$ at a heating connection 10*a*, 12*a*, 14*a*, 16*a* when a conducting path exists between the heating connection 10*a*, 12*a*, 14*a*, 16*a* and a frequency unit 26*a*, 28*a*. The ordinate axis 88*a* shows the electrical potential $V_1$ at the heating connection 10*a*, 12*a*, 14*a*, 16*a*. The abscissa axis 90*a* shows a time t. The potential profile $V_1(t)$ essentially has the form of a square-wave signal with steep flanks. Sharp edges mean that a frequency spectrum of the potential profile $V_1(t)$ contains high-frequency signal components, the frequency of which is above a switching frequency of the frequency units 26*a*, 28*a*.

Figure 3:
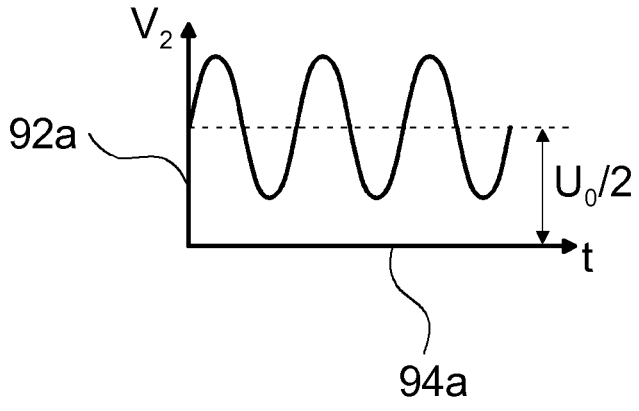
FIG. 3 shows a potential profile for an isolated connection.

FIG. 3 shows a Cartesian coordinate system for a typical potential profile $V_2(t)$ at a heating connection 10*a*, 12*a*, 14*a*, 16*a* in the absence of a conducting path between the heating connection 10*a*, 12*a*, 14*a*, 16*a* and a frequency unit 26*a*, 28*a*. The ordinate axis 92*a* shows the electrical potential $V_2$ at the heating connection 10*a*, 12*a*, 14*a*, 16*a*. The abscissa axis 94*a* shows a time t. The potential profile $V_2(t)$ essentially has the form of a sinusoidal signal displaced in the direction of the ordinate axis 92*a* by $U_0/2$. The potential profile $V_2(t)$ at the heating connection 10*a*, 12*a*, 14*a*, 16*a* is identical to a potential profile on a side of the heating element 18*a*, 20*a*, 22*a*, 24*a* assigned to the heating connection 10*a*, 12*a*, 14*a*, 16*a* facing away from said heating connection 10*a*, 12*a*, 14*a*, 16*a*, as in the absence of a conducting path between the heating connection 10*a*, 12*a*, 14*a*, 16*a* and the frequency unit 26*a*, 28*a* a current flow through the heating element 18*a*, 20*a*, 22*a*, 24*a* is zero. The approximately sinusoidal profile means that only a few signal components are contained in a frequency spectrum of the potential profile $V_2(t)$, their frequencies being around the switching frequency of the frequency units 26*a*, 28*a*.

To distinguish between the two different potential profiles $V_1(t)$, $V_2(t)$, the protective unit 30*a* comprises a high-pass filter with a limit frequency above the switching frequency of the frequency units 26*a*, 28*a* for each heating connection 10*a*, 12*a*, 14*a*, 16*a*. Signal components of the potential profiles $V_1(t)$, $V_2(t)$ with frequencies below the limit frequency are significantly damped, while signals with frequencies above the limit frequency are left almost unchanged. This allows discrimination between the potential profiles $V_1(t)$, $V_2(t)$ in respect of their frequency spectrum and the protective unit 30*a* can determine whether the conducting path exists between the heating connection 10*a*, 12*a*, 14*a*, 16*a* and a frequency unit 26*a*, 28*a*. If the conducting path exists, the protective unit 30*a* outputs a logic "0". If the conducting path is absent, the protective unit 30*a* outputs a logic Let it be assumed in one example that the two heating elements 18*a*, 24*a* are to be operated in dedicated mode. When the switching arrangement 66*a* is in the correct switch position, the two switching elements 68*a*, 70*a* are in the upper position and the switching elements 74*a*, 78*a* are in the lower position. The protective unit 30*a* forwards corresponding connection information to the control unit 32*a*, which the control unit 32*a* compares with a setpoint switch position. In the present instance the protective unit 30*a* forwards a "0" for the heating connection 10*a*, a "1" for the heating connection 12*a*, a "1" for the heating connection 14*a* and a "0" for the heating connection 16*a*. If we assume that the switching element 70*a* is in the wrong position, being in the lower position instead of the upper position, the protective unit 30*a* forwards a "1" for the heating connection 10*a*, a "0" for the heating connection 12*a*, a "1" for the heating connection 14*a* and a "0" for the heating connection 16*a* to the control unit 32*a*. In this error mode the heating element 20*a* is erroneously supplied with energy, which can potentially result in a dangerous operating state for an operator. The control unit 32*a* identifies this wrong position and switches off all the frequency units 26*a*, 28*a*. The control unit 32*a* also outputs a warning message and a maintenance request to an operator. If we assume that the switching element 68*a* is in the wrong position, being in the lower position instead of the upper position, the protective unit 30*a* forwards a "1" for the heating connection 10*a*, a "1" for the heating connection 12*a*, either a "0" or a "1" for the heating connection 14*a* as a function of a switch position of the switching element 72*a* and a "0" for the heating connection 16*a* to the control unit 32*a*. If the switching element 72*a* is in the upper position, the heating element 22*a* is erroneously supplied with energy, which can potentially result in a dangerous operating state for an operator. If the switching element 72*a* is in the lower position, both frequency units 26*a*, 28*a* are connected to the heating element 24*a* in a parallel manner and if the activation signals are different, in particular if the phasings are different, a short circuit of the inverters 44*a*, 46*a* and their destruction can result for the inverters 44*a*, 46*a* of the frequency units 26*a*, 28*a*. The control unit 32 identifies this wrong position and switches off all the frequency units 26*a*, 28*a*. The control unit 32*a* also outputs a warning message and a maintenance request to an operator.

Let it be assumed in a further example that the heating element 18*a* is to be operated in booster mode. When the switching arrangement 66*a* is in the correct switch position, the four switching elements 68*a*, 70*a*, 74*a*, 78*a* are in the upper position. The protective unit 30*a* forwards corresponding connection information to the control unit 32*a*, which the control unit 32*a* compares with a setpoint switch position. In the present instance the protective unit 30*a* forwards a "0" for the heating connection 10*a*, a "1" for the heating connection 12*a*, a "1" for the heating connection 14*a* and a "1" for the heating connection 16*a*. If we assume that the switching element 76*a* is in the wrong position, being in the lower position instead of the upper position, the protective unit 30*a* outputs a "0" for the heating connection 10*a*, a "0" for the heating connection 12*a*, a "1" for the heating connection 14*a* and a "1" for the heating connection 16*a* to the control unit 32*a*. In this error mode the two heating elements 18*a*, 20*a* are operated in a phase activation mode with activation signals of the inverters 44*a*, 46*a* of the frequency units 26*a*, 28*a* that have not been adapted for voltage-free switching. This can result in more significant switching losses and increased heating of the inverters 44*a*, 46*a*. The heating element 20*a* is also erroneously supplied with energy, which can potentially result in a dangerous operating state for an operator. The control unit 32*a* identifies this wrong position and switches off all the frequency units 26*a*, 28*a*. The control unit 32*a* also outputs a warning message and a maintenance request to an operator. If we assume that the switching element 74*a* is in the wrong position, being in the lower position instead of the upper position, the protective unit 30*a* forwards a "0" for the heating connection 10*a*, a "1" for the heating connection 12*a* and either a "0" for the heating connection 14*a* and a "1" for the heating connection 16*a* or a "1" for the heating connection 14*a* and a "0" for the heating connection 16*a* as a function of a switch position of the switching element 78*a* to the control unit 32*a*. In this error mode either the heating element 22*a* or the heating element 24*a* is erroneously supplied with energy as a function of the switching state of the switching element 78*a*, which can potentially result in a dangerous operating state for an operator. The control unit 32*a* identifies this wrong position and switches off all the frequency units 26*a*, 28*a*. The control unit 32*a* also outputs a warning message and a maintenance request to an operator.

Let it be assumed in a last example that the two heating elements 18*a*, 20*a* are to be operated in phase activation mode. When the switching arrangement 66*a* is in the correct switch position, the three switching elements 68*a*, 70*a*, 74*a* are in the upper position and the switching element 76*a* is in the lower position. The protective unit 30*a* forwards corresponding connection information to the control unit 32*a*, which the control unit 32*a* compares with a setpoint switch position. In the present instance the protective unit 30*a* forwards a "0" for the heating connection 10*a*, a "0" for the heating connection 12*a*, a "1" for the heating connection 14*a* and a "1" for the heating connection 16*a*. If we assume that the switching element 76*a* is in the wrong position, being in the upper position instead of the lower position, the protective unit 30*a* forwards a "0" for the heating connection 10*a*, a "1" for the heating connection 12*a*, a "1" for the heating connection 14*a* and a "1" for the heating connection 16*a* to the control unit 32*a*. In this error mode the two frequency units 26*a*, 28*a* are connected to the heating element 18*a* in a parallel manner and if the activation signals are different, in particular if the phasings are different, a short circuit of the inverters 44*a*, 46*a* and their destruction can result for the inverters 44*a*, 46*a* of the frequency units 26*a*, 28*a*. The control unit 32 identifies this wrong position and switches off all the frequency units 26*a*, 28*a*. The control unit 32*a* also outputs a warning message and a maintenance request to an operator. If we assume that the switching element 74*a* is in the wrong position, being in the lower position instead of the upper position, the protective unit 30*a* forwards a "0" for the heating connection 10*a*, a "1" for the heating connection 12*a* and either a "0" for the heating connection 14*a* and a "1" for the heating connection 16*a* or a "1" for the heating connection 14*a* and a "0" for the heating connection 16*a* as a function of a switch position of the switching element 78*a* to the control unit 32*a*. In this error mode either the heating element 22*a* or the heating element 24*a* is erroneously supplied with energy as a function of a switch position of the switching element 78*a*, which can potentially result in a dangerous operating state for an operator. The control unit 32*a* identifies this wrong position and switches off all the frequency units 26*a*, 28*a*. The control unit 32*a* also outputs a warning message and a maintenance request to an operator.

Alternatively or additionally the protective unit 30*a* can also comprise a current sensor, in order to determine the existence of the conducting path in at least one operating state. Alternatively or additionally the heating apparatus can comprise at least one current meter, which is provided to measure an electrical current through the conducting path.

Figure 1B:
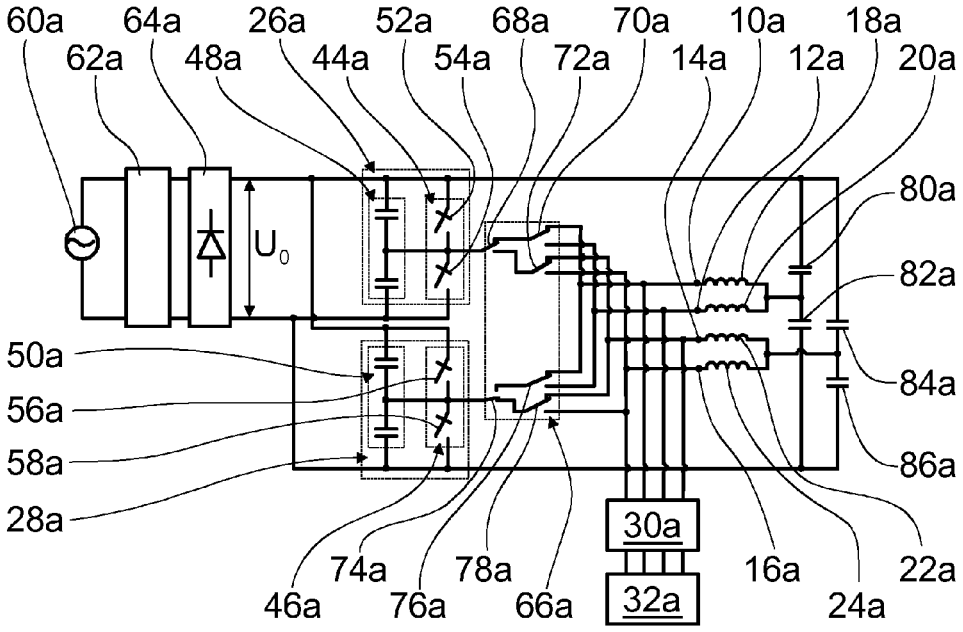
FIG. 1*b* shows a heating apparatus of the induction cooktop from FIG. 1*a*.
Figure 4A:
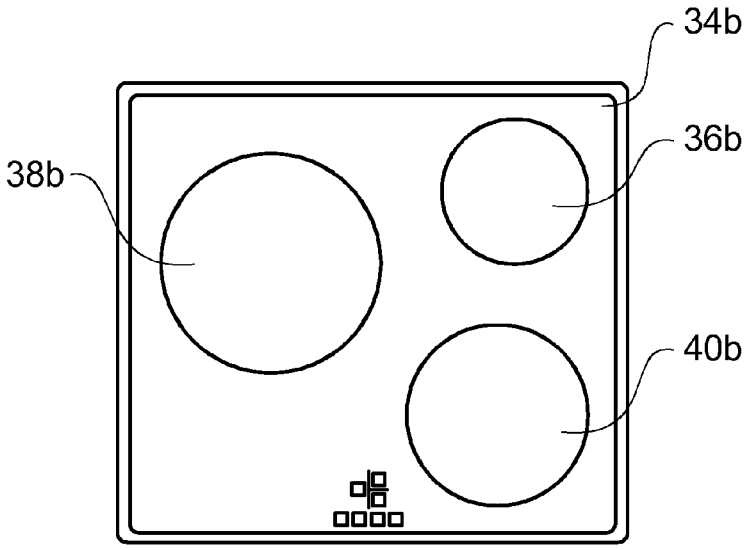
FIG. 4*a* shows an induction cooktop with three heating zones viewed from above.
Figure 4B:
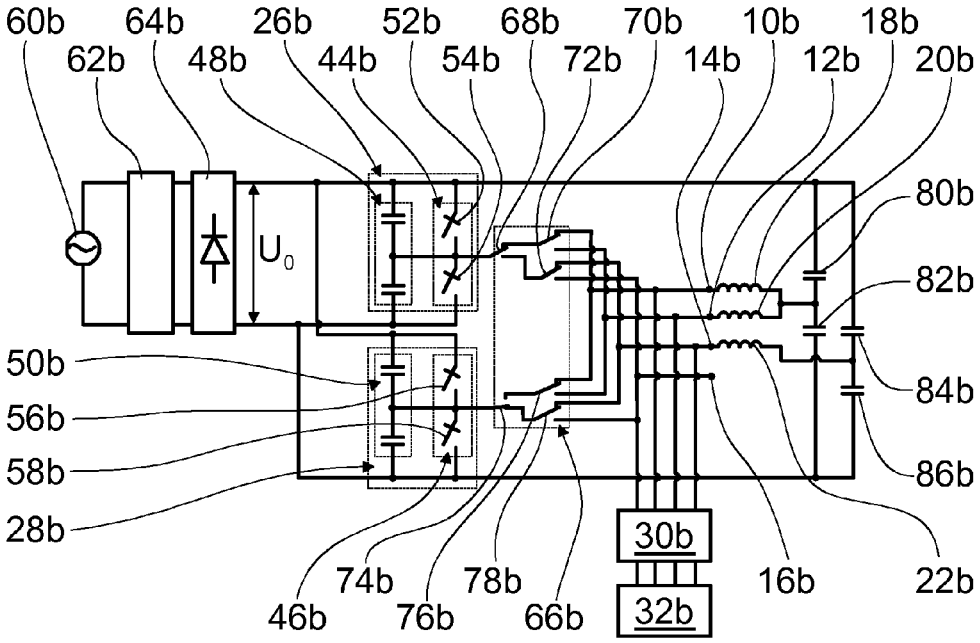
FIG. 4*b* shows a heating apparatus of the induction cooktop from FIG. 4*a*.

FIGS. 4*a* and 4*b* show a further exemplary embodiment of the invention. The descriptions which follow are limited essentially to the differences between the exemplary embodiments, it being possible to refer to the description of the other exemplary embodiments, in particular FIGS. 1*a* and 1*b*, in respect of identical components, features and functions. To distinguish between the exemplary embodiments the letter a in the reference characters of the exemplary embodiment in FIGS. 1*a* and 1*b* is replaced by the letter b in the reference characters of the exemplary embodiment in FIGS. 4*a* and 4*b*. Reference can also be made in principle to the drawings and/or the description of the other exemplary embodiment, in particular in FIGS. 1*a* and 1*b*, in respect of identically designated components, in particular in respect of components with identical reference characters.

FIG. 4*a* shows a second induction cooktop with a cooktop plate 34*b* made of a glass ceramic, viewed from above. Three circular heating zones 36*b*, 38*b*, 40*b* are marked on the cooktop plate 34*b* in the known manner. FIG. 4*b* shows an electrical circuit diagram of a second heating apparatus of the second induction cooktop. The heating apparatus only comprises three heating elements 18*b*, 20*b*, 22*b*, which can be connected by way of a switching arrangement 66*b* to two frequency units 26*b*, 28*b*. To minimize production costs by reducing the number of different types of heating apparatuses, the heating apparatus from FIG. 4*b* also comprises a heating connection 16*b* for a fourth heating element, which can be connected by way of the switching element 72*b* to the frequency unit 26*b* and by way of the switching element 78*b* to the frequency unit 28*b*. This gives rise to a further possible error, namely where one of the two switching elements 72*b*, 78*b* establishes a conducting path between one of the frequency units 26*b*, 28*b* and the heating connection 16*b*. An inverter 44*b*, 46*b* of the frequency unit 26*b*, 28*b* would then have a damping capacitor unit 48*b*, 50*b* associated with the frequency unit 26*b*, 28*b* as its only load. The inverters 44*b*, 46*b* can survive this operating mode undamaged for a short time. The purpose of a protective unit 30*b* of the heating apparatus is to identify this operating mode promptly. See the description of the previous exemplary embodiment for a precise description of the mode of operation of the protective unit 30*b*.

In principle it is conceivable for a heating apparatus to have further switching elements and more than four heating elements, which are connected to frequency units by means of the further switching elements. In principle it is conceivable for the switching elements, which are configured as SPDT relays, each to be replaced by two SPST relays.

The invention claimed is:

1. A heating apparatus configured for a cooktop, the heating apparatus comprising:

at least one heating connection for at least one heating element, at least one frequency unit, a switching arrangement including at least one switching element coupling the at least one frequency unit to the at least one heating connection, and a protective unit coupled to the at least one heating connection, the protective unit configured to determine whether a conducting path exists between the frequency unit and the at least one heating connection; and a control unit configured to receive connection information from the protective unit and determine an erroneous existence of the conducting path.

2. The heating apparatus of claim 1, wherein the heating apparatus is constructed as a cooktop heating apparatus.

3. The heating apparatus of claim 1, wherein the protective unit is configured to determine whether the conducting path exists based on a potential profile.

4. The heating apparatus of claim 3, wherein the protective unit is configured to analyze the potential profile at the at least one heating connection.

5. The heating apparatus of claim 3, wherein the protective unit is configured to determine whether the conducting path exists based on a frequency spectrum of the potential profile.

6. The heating apparatus of claim 3, wherein the protective unit comprises at least one high-pass filter configured to discriminate between potential profiles.

7. The heating apparatus of claim 1, wherein the protective unit comprises a current sensor configured to determine whether the conducting path exists.

8. The heating apparatus of claim 1, wherein the control unit is configured to initiate at least one safety measure in response to determining the erroneous existence of the conducting path.

9. The heating apparatus of claim 1, wherein a total number of heating elements is greater than a total number of frequency units.

10. A cooktop, comprising:

a heating apparatus including:

at least one heating connection for at least one heating element, at least one frequency unit, a switching arrangement including at least one switching element coupling the at least one frequency unit to the at least one heating connection, and a protective unit coupled to the at least one heating connection, the protective unit configured to determine whether a conducting path exists between the frequency unit and the at least one heating connection; and a control unit configured to receive connection information from the protective unit and determine an erroneous existence of the conducting path.

11. The cooktop of claim 10, wherein the cooktop is an induction cooktop.

12. The cooktop of claim 10, wherein the heating apparatus is constructed as a cooktop heating apparatus.

13. The cooktop of claim 10, wherein the protective unit is configured to determine whether the conducting path exists based on a potential profile.

14. The cooktop of claim 13, wherein the protective unit is configured to analyze the potential profile at the at least one heating connection.

15. The cooktop of claim 13, wherein the protective unit is configured to determine whether the conducting path exists based on a frequency spectrum of the potential profile.

16. The cooktop of claim 13, wherein the protective unit comprises at least one high-pass filter configured to discriminate between potential profiles.

17. The cooktop of claim 10, wherein the protective unit comprises a current sensor configured to determine whether the conducting path exists.

18. The cooktop of claim 10, wherein the control unit is configured to initiate at least one safety measure in response to determining the erroneous existence of the conducting path.

19. The cooktop of claim 10, wherein a total number of heating elements is greater than a total number of frequency units.

20. The heating apparatus of claim 8, wherein the at least one safety measure includes the control unit switching off the at least one frequency unit.

21. The heating apparatus of claim 1, wherein the control unit is configured to compare the connection information with a switch position of the switching element, wherein the control unit is configured to initiate at least one safety measure when the connection information deviates from the switch position, and wherein the at least one safety measure includes the control unit switching off the at least one frequency unit.

22. The heating apparatus of claim 1, wherein the heating apparatus comprises:

a plurality of heating elements;

a plurality of heating connections for the plurality of heating elements; and a plurality of frequency units;

wherein the switching arrangement includes a plurality of switching elements coupling the plurality of frequency units to the plurality of heating connections, and wherein the protective unit is configured to determine whether the conducting path exists between the plurality of frequency units and the plurality of heating connections.

23. The heating apparatus of claim 22, wherein a total number of heating elements is greater than a total number of frequency units.

24. The heating apparatus of claim 22, wherein the control unit is configured to compare the connection information with switch positions of the plurality of switching elements, wherein the control unit is configured to initiate at least one safety measure when the connection information deviates from the switch positions, and wherein the at least one safety measure includes the control unit switching off all of the plurality of frequency units.

25. The cooktop of claim 18, wherein the at least one safety measure includes the control unit switching off the at least one frequency unit.

26. The cooktop of claim 10, wherein the control unit is configured to compare the connection information with a switch position of the switching element, wherein the control unit is configured to initiate at least one safety measure when the connection information deviates from the switch position, and wherein the at least one safety measure includes the control unit switching off the at least one frequency unit.

27. The heating apparatus of claim 8, wherein the control unit determines the erroneous existence of the conducting path when the at least one heating element is energized when the control unit has set the at least one switching element for the at least one heating element to be de-energized.

28. The heating apparatus of claim 8, wherein the connection information includes a connection status between the frequency unit and the at least one heating connection.

29. The heating apparatus of claim 28, wherein the connection information is encoded in a digital signal.

30. The heating apparatus of claim 20, wherein the at least one safety measure further includes the control unit outputting at least one of an error message and a maintenance request.

31. The cooktop of claim 18, wherein the control unit determines the erroneous existence of the conducting path when the at least one heating element is energized when the control unit has set the at least one switching element for the at least one heating element to be de-energized.

32. The heating apparatus of claim 1, wherein the protective unit is coupled to the at least one heating connection between the at least one switching element and the at least one heating element.

33. The heating apparatus of claim 1, wherein the erroneous existence of the conducting path is an existence of the conducting path between the frequency unit and the heating connection due to the at least one switching element being defective.

34. The heating apparatus of claim 1, wherein the erroneous existence of the conducting path is an existence of the conducting path between the frequency unit and the heating connection due to the at least one switching element being erroneously activated.

* * * * *